US008652729B2

(12) United States Patent
Tomonaga et al.

(10) Patent No.: US 8,652,729 B2
(45) **Date of Patent: *Feb. 18, 2014**

(54) TONER FOR ELECTROSTATIC IMAGE DEVELOPMENT, DEVELOPER FOR ELECTROSTATIC IMAGE DEVELOPMENT, DEVELOPER CARTRIDGE, PROCESS CARTRIDGE, AND IMAGE-FORMING APPARATUS, AND IMAGE-FORMING METHOD

(75) Inventors: Junichi Tomonaga, Kanagawa (JP); Hitomi Akiyama, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 219 days.

This patent is subject to a terminal disclaimer.

(21) Appl. No.: 13/035,279

(22) Filed: Feb. 25, 2011

(65) Prior Publication Data

US 2012/0077118 A1 Mar. 29, 2012

(30) Foreign Application Priority Data

Sep. 24, 2010 (JP) ..... 2010-213835

(51) Int. Cl.
*G03G 9/00* (2006.01)

(52) U.S. Cl.
USPC ..... 430/109.4; 430/108.1; 430/109.1

(58) Field of Classification Search
USPC ..... 430/108.1, 109.1, 109.4, 110.1, 110.3
See application file for complete search history.

(56) References Cited

U.S. PATENT DOCUMENTS

| | | | | |
|---|---|---|---|---|
| 6,001,524 | A * | 12/1999 | Yoon et al. | 430/109.4 |
| 6,517,985 | B2 * | 2/2003 | Takagi et al. | 430/45.54 |
| 2002/0115009 | A1 | 8/2002 | Takagi et al. | |
| 2010/0075240 | A1 * | 3/2010 | Akiyama et al. | 430/105 |
| 2010/0075241 | A1 | 3/2010 | Kazmaier et al. | |
| 2010/0261114 | A1 * | 10/2010 | Akiyama et al. | 430/108.23 |
| 2010/0261115 | A1 * | 10/2010 | Tomonaga et al. | 430/108.23 |
| 2012/0077118 | A1 | 3/2012 | Tomonaga et al. | |
| 2012/0115081 | A1 * | 5/2012 | Akiyama et al. | 430/109.4 |

FOREIGN PATENT DOCUMENTS

| | | |
|---|---|---|
| JP | A-56-11461 | 2/1981 |
| JP | A-62-39879 | 2/1987 |
| JP | B2-62-39428 | 8/1987 |
| JP | A-63-282752 | 11/1988 |
| JP | A-2008-70455 | 3/2008 |
| JP | A-2009-69647 | 4/2009 |
| JP | A-2009-122522 | 6/2009 |

OTHER PUBLICATIONS

Dec. 4, 2012 Office Action issued in U.S. Appl. No. 13/090,706.
U.S. Appl. No. 13/090,706 to Akiyama et al., filed Apr. 20, 2011.
Apr. 4, 2013 Office Action issued in U.S. Appl. No. 13/090,706.

* cited by examiner

*Primary Examiner* — Stewart Fraser
(74) *Attorney, Agent, or Firm* — Oliff & Berridge, PLC

(57) ABSTRACT

A toner for electrostatic image development including: a toner particle containing a polyester resin and a coloring agent; and an uncolored particle containing a polyester resin and not containing a coloring agent, wherein shape factor SF1 of the uncolored particles is 110 or less, and the number of the uncolored particles is 50 or less based on 5,000 toner particles.

10 Claims, 2 Drawing Sheets

TONER FOR ELECTROSTATIC IMAGE DEVELOPMENT, DEVELOPER FOR ELECTROSTATIC IMAGE DEVELOPMENT, DEVELOPER CARTRIDGE, PROCESS CARTRIDGE, AND IMAGE-FORMING APPARATUS, AND IMAGE-FORMING METHOD

CROSS-REFERENCE TO RELATED APPLICATION(S)

The present application claims priority from Japanese Patent Application No. 2010-213835 filed on Sep. 24, 2010, the entire content of which is incorporated herein by reference.

BACKGROUND

1. Field

The present invention relates to toner for an electrostatic image development, a developer for electrostatic image development, a developer cartridge, a process cartridge, an image-forming apparatus, and an image-forming method.

2. Description of the Related Art

Methods of visualizing image data via an electrostatic image such as an electrophotographic method are now widely used in various fields. In the electrophotographic method, an image is visualized through processes of forming an electrostatic latent image on an electrostatic latent image holding member by charging and exposure (a latent image-forming process), developing the electrostatic latent image with an electrostatic image developer (hereinafter sometimes referred to as merely "a developer") containing an electrostatic image developing toner (hereinafter sometimes referred to as merely "a toner") (a developing process), a transferring process and a fixing process. The residues of the toner and the like remaining on the surface of the image holding member after transfer are removed and cleaned with an image holding member-cleaning unit such as a cleaning blade and the like (an image holding member-cleaning process). As developers to be used here, two types of a two-component type developer including a toner and a carrier, and a one-component type developer using a magnetic toner or a nonmagnetic toner alone are known.

SUMMARY

A toner for electrostatic image development including: a toner particle containing a polyester resin and a coloring agent; and an uncolored particle containing a polyester resin and not containing a coloring agent, wherein shape factor SF1 of the uncolored particles is 110 or less, and the number of the uncolored particles is 50 or less based on 5,000 toner particles.

DETAILED DESCRIPTION OF EXEMPLARY EMBODIMENTS

Figure 1:
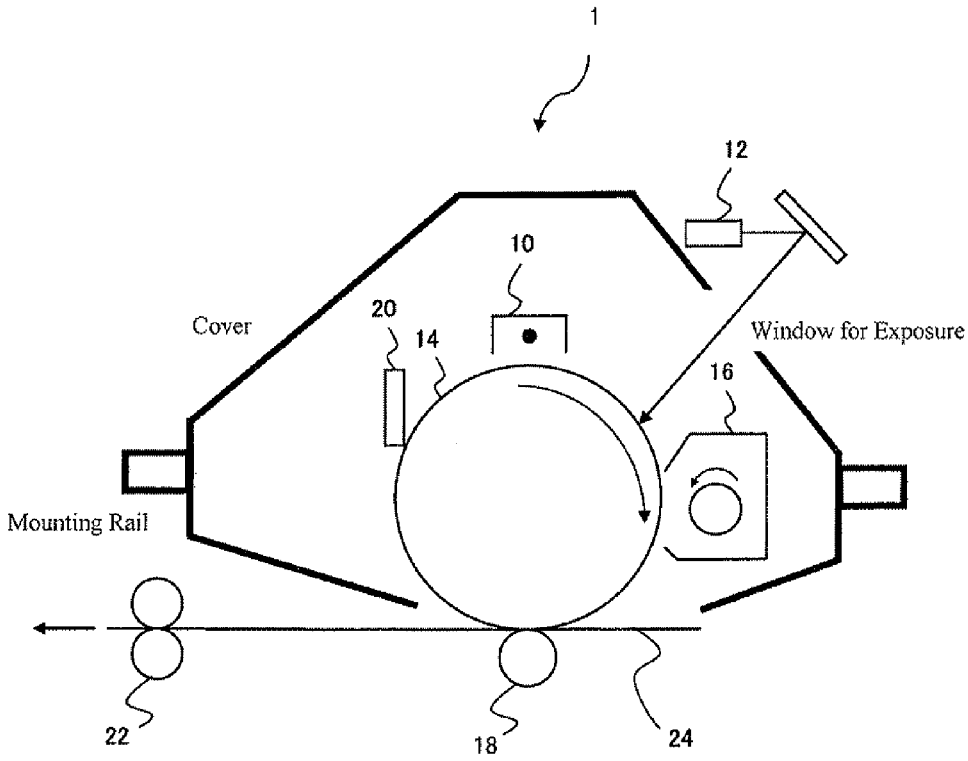
FIG. 1 is a schematic block diagram showing an example of the process cartridge in the exemplary embodiment in the invention.

An exemplary embodiment of the invention will be described below. The exemplary embodiment is an example for carrying out the invention and the invention is not restricted thereto.

<Electrostatic Image Developing Toner>

The toner in the exemplary embodiment of the invention includes toner particles containing a polyester resin and a coloring agent, and uncolored particles containing a polyester resin and not containing a coloring agent, wherein shape factor SF1 of the uncolored particles is 110 or less, and the number of the uncolored particles is 50 or less based on 5,000 toner particles.

The toner according to the exemplary embodiment of the invention is manufactured, as described later, for example, via an aggregation process of forming aggregated particles and a fusion process of fusing the aggregated particles in starting material dispersion obtained by the mixing coloring agent dispersion obtained by dispersing a coloring agent in a solvent, and if necessary, dispersion in which other various materials constituting the toner are dispersed in a solvent, with resin particle dispersion obtained by dispersing resin particles containing a polyester resin in a solvent by the use of a phase inversion emulsification method.

There are cases where uncolored particles not containing a coloring agent having a particle size relatively similar to the particle size of toner particles are mixed into a toner containing a polyester resin. Polyester resins are generally synthesized by polycondensation reaction of acid component and alcohol component, and in many cases a catalytic compound containing an Sn element is used in this polymerization as the catalyst (hereinafter sometimes merely referred to as "a tin-containing catalyst). For example, in the polymerization of a polyester resin using a tin-containing catalyst as the catalyst, when the monomers of the unreacted acid component and alcohol component remain in the resin, the monomer of the acid component of the residual components has a carboxylic acid as the functional group, which is high in polarity and hydrophilicity. When the ionic Sn element of the tin-containing catalyst, which is not included in the polyester structure in the polymerization process of the polyester resin, forms a complex with the residual acid component, the acid component containing carboxylic acid adhered on the surfaces of the resin particles comes to decrease during the manufacture of an emulsified resin (latex) using this resin, as a result, the hydrophilicity lowers, and it is presumed that resin particles having a particle size relatively similar to that of the toner particles or a relatively large particle size (hereinafter sometimes referred to as merely "coarse resin particles") are generated by the restraint of reduction of surface area.

When a tin-containing catalyst is used as the catalyst in the synthesis of a polyester resin, polymerization reaction progresses with the tin-containing catalyst as the reaction starting point. However, the tin-containing catalyst localizes at a part where the viscosity of the reaction system is relatively low and polymerization reaction progresses at the localized part while generating heat. Since viscosity does not rise at that part due to the exothermic heat, polymerization further proceeds. As a result, it is presumed that coarse resin particles having a relatively high molecular weight and a comparatively high glass transition temperature are generated.

When aggregated particles are formed in coloring agent dispersion using resin particle dispersion containing such coarse resin particles and, if necessary, other starting material dispersion, ordinary resin particles having a relatively small particle size (for example, 200 nm or so) impinge and repeat aggregation by performing Brownian motion and take in the coloring agent to form toner particles. On the other hand, coarse resin particles hardly perform Brownian motion and do not take in the coloring agent, and they remain almost as they are as uncolored particles not containing the coloring agent. The uncolored particles are supposed to come to particles having relatively high molecular weight and glass transition temperature, as described above.

Thus, uncolored particles having a particle size relatively similar to that of the toner particles or a relatively large particle size and not containing a coloring agent are mixed in the toner containing the polyester resin.

In the toner according to the exemplary embodiment, the number of such uncolored particles is 50 or less, preferably 30 or less, and more preferably 15 or less, based on 5,000 toner particles. If the number of uncolored particles exceeds 50 based on 5,000 toner particles, since the uncolored particles are high in mechanical strength, when output in the state of almost white paper such as image density of 5% is repeated, a load is applied to the cleaning blade to cause deformation of the cleaning blade. When deformation of the cleaning blade is caused, the property of cleaning toner particles is also impaired and an image quality defect such as a color streak is caused. That is, when the number of uncolored particles is 50 or less based on 5,000 toner particles, deformation of the cleaning blade is restrained even if the cleaning blade is used as the cleaning unit of an image holding member and occurrence of an image quality defect such as a color streak is inhibited. The smaller the number of the uncolored particles based on 5,000 toner particles, the better, but there are cases where 5 or more or 10 or more uncolored particles are present.

In the toner according to the exemplary embodiment, for making the number of the uncolored particles 50 or less based on 5,000 toner particles, there are exemplified, for example, a method of excluding the coarse resin particles by centrifugal separation treatment or natural precipitation treatment after phase inversion emulsification of the polyester resin, and a method of controlling the conditions of deliquoring after phase transfer emulsification of the polyester resin in blast at normal temperature (e.g., 20° C. or more and 30° C. or less) and normal pressure (e.g., 700 mmHg or more and 800 mmHg or less) not on the conditions of heating and pressure reduction. Further, the localization of the tin-containing catalyst in the reaction system and generation of coarse resin particles may be restrained by such a method for adding a tin-containing catalyst to the reaction system at the time of manufacturing a polyester resin that a tin-containing catalyst is added to the reaction system in one step as far as possible.

In the specification of the invention, the terminology "uncolored particles do not contain a coloring agent" means that the content of the coloring agent contained in the uncolored particles, which can be found according to the method described hereinafter in the example, is 10 ppm or less.

In the toner according to the exemplary embodiment, SF1 of uncolored particles is 110 or less. This is for the reason that particles are formed so as to make the surface area as small as possible in a phase inversion emulsification. When SF1 of uncolored particles exceeds 110, cleaning has been substantially done, accordingly problems are hardly caused.

With the increase of content of Sn element in toner particles or uncolored particles, the mechanical strength and heat resistance of the particles rise. This is presumably due to the fact that Sn element contributes to formation of ionic crosslinking in the matrix of toner particles or uncolored particles, so that the molecular weight and glass transition temperature become relatively high. When the content of the Sn element contained in the uncolored particles is more than the content of the Sn element contained in the toner particles, the uncolored particles having relatively high in mechanical strength are present in the toner particles, as a result, when a cleaning blade is used as the cleaning unit of an image holding member, deformation of the cleaning blade is caused and an image quality defect such as a color streak is liable to occur. However, by making the number of the uncolored particles 50 or less based on 5,000 toner particles, even when a cleaning blade is used as the cleaning unit of an image holding member, deformation of the cleaning blade is restrained and generation of an image quality defect such as a color streak is inhibited.

In the specification of the invention, "Sn element" more accurately means the content originating in the ionic Sn element such as that contained in a tin compound catalyst used in polymerization of a polyester resin, and components originating in covalent bonding Sn elements such as tin oxides are excluded.

In the specification of the invention, "the content of the Sn element contained in the uncolored particles is more than the content of the Sn element contained in the toner particles" means that the content of the Sn element contained in the uncolored particles found by the method described later in the example is more than the content of the Sn element contained in the toner particles. For example, a ratio of the amount of Sn element contained in the uncolored particle to the amount Sn element contained in the toner particle is 1.1 or more and 3.0 or less, and preferably 1.1 or more and 2.0 or less. When the content of the Sn element contained in the uncolored particles is in the range of 3 times or less of the content of the Sn element contained in the toner particles, the above-described deformation of the cleaning blade is further restrained and generation of a color streak is inhibited. As specific methods, it is effective to use a method of taking time in dispersion of a catalyst at the time of polycondensation, and a method of performing stirring once at a low temperature for increasing viscosity at the time of dispersion.

In the toner according to the exemplary embodiment, it is preferred for a polyester resin to contain alkenylsuccinic acid or the like as the constitutional component. There is a case where a complex with an acid component is difficult to be formed by steric hindrance when a polyester resin contains alkenylsuccinic acid or the like as the constitutional component.

The contents of Sn elements in the toner particles and uncolored particles, and the shape factor SF1, number, weight average molecular weight, glass transition temperature and constitutional components of the uncolored particles are measured as described later in the example.

(Constitutional Components of Toner)

The toner particles and uncolored particles in the electrostatic image developing toner according to the exemplary embodiment contain polyester resins. The toner particles further contain a coloring agent and, if necessary, a release agent and other components.

A polyester resin is synthesized from an acid component (polyvalent carboxylic acid) and alcohol component (polyhydric alcohol). In the exemplary embodiment, "a constituent deriving from an acid" means a constitutional part which is an acid component before synthesis of a polyester resin, and "a constituent deriving from an alcohol" means a constitutional part which is an alcohol component before synthesis of a polyester resin.

[Constitutional Components Deriving from Acid]

Constitutional components deriving from an acid are not especially restricted and aliphatic dicarboxylic acids and aromatic carboxylic acids are preferably used. The examples of the aliphatic dicarboxylic acids include, e.g., oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof, but the invention is not restricted thereto. The examples of the aromatic carboxylic acids include lower alkyl esters and acid anhydrides of aromatic carboxylic acids, e.g., terephthalic acid, isophthalic acid, phthalic anhydride, trimellitic anhydride, pyromellitic acid, and naphthalenedicarboxylic acid. Alicyclic carboxylic acids, e.g., cyclohexanedicarboxylic acid are also exemplified. Further, for securing a good fixing property, it is preferred to use trivalent or more carboxylic acid (trimellitic acid and acid anhydride thereof) in combination with dicarboxylic acid to take a crosslinking structure or a branched structure. As the specific examples of the alkenylsuccinic acids, dodecenylsuccinic acid, dodecylsuccinic acid, stearylsuccinic acid, octylsuccinic acid, and octenylsuccinic acid are exemplified.

[Constitutional Components Deriving from Alcohol]

Constitutional components deriving from alcohol are not especially restricted. For example, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol are exemplified as aliphatic diols. Further, diethylene glycol; triethylene glycol; neopentyl glycol and glycerol; alicyclilc diols, e.g., cyclohexanediol, cyclohexanedimethanol and hydrogenated bisphenol A; and aromatic diols, e.g., ethylene oxide adduct of bisphenol A and propylene oxide adduct of bisphenol A are used. In addition, to secure a good fixing property, trivalent or more polyhydric alcohols (glycerol, trimethylolpropane, pentaerythritol) may be used in combination with diols for taking a crosslinking structure or a branched structure.

Manufacturing methods of polyester resins are not especially restricted and they may be manufactured by general polyester polymerization methods of reacting an acid component and an alcohol component. For example, direct polycondensation and ester exchange methods are exemplified, and the methods may be used properly according to the kind of the monomer. The molar ratio (acid component/alcohol component) in reacting the acid component and the alcohol component depends on the reaction conditions and cannot be said unconditionally, but it is generally 1/1 or so.

Polyester resins may be manufactured in polymerization temperature at, for example, 180° C. or more and 230° C. or less, and if necessary, the reaction may be conducted under reduced pressure in the reaction system while removing the water and alcohol generated by condensation. When the monomer is not dissolved or compatibilized under the reaction temperature, there are cases where the reaction partially progresses rapidly or slowly and much uncolored particles are generated. Accordingly, a solvent having a high boiling temperature may be added as the dissolution auxiliary for dissolution. In polycondensation reaction, the reaction may be carried out while distilling off the dissolution auxiliary. In copolymerization reaction, when a monomer inferior in compatibility is present, the monomer inferior in compatibility may be condensed in advance with the acid or alcohol to be polycondensed and then polycondensed together with the main component.

As the catalysts that may be used in the manufacture of polyester resins, alkali metal compounds, e.g., sodium and lithium; alkaline earth metal compounds, e.g., magnesium and calcium; metal compounds, e.g., zinc, manganese, antimony, titanium, tin, zirconium, and germanium; phosphorous acid compounds, phosphoric acid compounds and amine compounds are exemplified. Of these catalysts, it is preferred to use tin-containing catalysts, e.g., tin, tin formate, tin oxalate, tetraphenyltin, dibutyltin dichloride, dibutyltin oxide and diphenyltin oxide.

By controlling the addition amount of the tin-containing catalyst, the content of Sn element to the toner particles and uncolored particles is controlled. The content of the tin-containing catalyst is preferably, for example, 0.1 parts by weight or more and 5.0 parts by weight or less based on 100 parts by weight of the monomer components, and more preferably 0.1 parts by weight or more and 3.0 parts by weight or less.

Further, the localization of the tin-containing catalyst in the reaction system and generation of coarse resin particles may be restrained by such a method for adding a tin-containing catalyst to the reaction system at the time of manufacturing a polyester resin that a tin-containing catalyst is added to the reaction system in one step as far as possible.

The tin-containing catalysts include organic tin-containing catalysts and inorganic tin-containing catalysts. Organic tin-containing catalysts are compounds having an Sn—C bond, and inorganic tin-containing catalysts are compounds not having an Sn—C bond. The tin-containing catalysts include di-, tri- and tetra-functional types and a di-functional type is preferably used. Inorganic tin-containing catalysts are preferred.

As inorganic tin-containing catalysts besides the above, unbranched type tin alkyl carboxylates, e.g., tin diacetate, tin dihexanoate, tin dioctanoate, and tin distearate; branched and unbranched type tin alkyl carboxylates, e.g., tin dineopentylate and tin di(2-ethylhexylate); tin carboxylate, e.g., tin oxalate; dialkoxytin, e.g., dioetyloxytin and distearoxytin, tin halide; e.g., tin chloride and tin bromide, tin oxide and tin sulfate are exemplified, and tin dioctanoate, tin distearate and tin oxide are especially preferably used.

In the exemplary embodiment, as the resins for electrostatic image developing toner, compounds having a hydrophilic polar group may be used so long as they are compounds capable of copolymerization. The specific examples include, for the case where polyester is used as the resin, dicarboxylic acid compounds having a sulfonyl group directly substituted on the aromatic ring, such as sodium sulfonylterephthalate and sodium 3-sulfonylisophthalate.

The weight average molecular weight Mw of polyester resins is preferably 5,000 or more, and more preferably in the range of 5,000 or more and 50,000 or less. To contain such a polyester resin is advantageous in scratch resistance and sliding property. When the weight average molecular weight Mw of polyester resins is lower than 5,000, the toner particles are liable to be deformed, and in some cases the toner particles are liable to be liberated, as a result there are cases where problems resulting from the liberated resins (filming, increase of finely divided powder due to brittleness, deterioration of fluidity of powder, and the like) arise.

In the toner according to the exemplary embodiment, resins other than polyester resins may be contained. Resins which may be used are not especially limited, but specifically styrenes, e.g., styrene, parachlorostyrene, and α-methylstyrene; acrylic monomers, e.g., methyl acrylate, ethyl acrylate, n-propyl acrylate, butyl acrylate, lauryl acrylate, and 2-ethylhexyl acrylate; methacrylic monomers, e.g., methyl methacrylate, ethyl methacrylate, n-propyl methacrylate, lauryl methacrylate, and 2-ethylhexyl methacrylate; ethylene unsaturated acid monomers, e.g., acrylic acid, methacrylic acid and sodium styrenesulfonate; vinylnitriles, e.g., acrylonitrile and methacrylonitrile; vinyl ethers, e.g., vinyl methyl ether and vinyl isobutyl ether; vinyl ketones, e.g., vinyl methyl ketone, vinyl ethyl ketone and vinyl isopropenyl ketone; homopolymers of olefin monomers, e.g., ethylene, propylene, and butadiene; copolymers of combining two or more of these monomers; mixtures thereof; non-vinyl condensed resins, e.g., epoxy resins, polyester resins, polyurethane resins, polyamide resins, cellulose resins, and polyether resins; mixtures of the non-vinyl condensed resins and any of the above vinyl resins; and graft polymers obtained by polymerization of vinyl monomers in the presence of the non-vinyl condensed resins are exemplified. These resins may be used one kind alone or two or more in combination. Of the above resins, styrene resins and acrylic resins are especially preferably used.

The specific examples of release agents include low molecular weight polyolefins, e.g., polyethylene, polypropylene and polybutene; silicones coming to have a softening temperature by heating; fatty acid amides, e.g., oleic amide, erucic amide, ricinoleic amide, and stearic amide; vegetable waxes, e.g., carnauba wax, rice wax, candelilla wax, Japan wax, and jojoba oil; animal waxes, e.g., bees wax; mineral and petroleum waxes, e.g., montan wax, ozokerite, ceresine, paraffin wax, microcrystalline wax, and Fischer-Tropsch wax; and modified products of them.

These release agents may be used alone, or may be used in combination of two or more. The content of these release agents is preferably 1 part by weight or more and 10 parts by weight or less to 100 parts by weight of the binder resin, and more preferably 5 parts by weight or more and 9 parts by weight or less.

The coloring agent for use in the toner according to the exemplary embodiment may be either dyes or pigments, but pigments are preferred from the viewpoints of light fastness and water tightness. As preferred pigments, known pigments may be used, e.g., carbon black, Aniline Black, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, Quinacridone, Benzidine Yellow, C.I. Pigment Red 48:1, C.I. Pigment Red 57:1, C.I. Pigment Red 122, C.I. Pigment Red 185, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3 are exemplified. Magnetic powders may be used as coloring agents. Known magnetic substances may be used as the magnetic powders, for example, ferromagnetic metals, e.g., cobalt, iron and nickel, alloys and oxides of metals, e.g., cobalt, iron, nickel, aluminum, lead, magnesium, zinc and manganese are exemplified.

These coloring agents may be used alone, or may be used in combination of two or more. The content of these coloring agents is preferably 0.1 parts by weight or more and 40 parts by weight or less based on 100 parts by weight of the binder resin, and more preferably 1 part by weight or more and 30 parts by weight or less.

By selecting the kinds of the coloring agents, a toner of each color of a yellow toner, a magenta toner, a cyan toner and a black toner can be obtained.

Other components are not especially restricted and they may be optionally selected according to the purpose, and various known additives, for example, inorganic particles and a charge controlling agent are exemplified.

Inorganic particles may be added to the toner in the exemplary embodiment, if necessary. As the inorganic particles, known inorganic particles such as silica particles, titanium oxide particles, alumina particles, cerium oxide particles, and these inorganic particles subjected to surface treatment may be used alone or in combination of two or more. In view of a color developing property and not impairing transparency such as overhead projector (OHP) transmission, silica particles having a smaller refractive index than that of the binder resin are preferred. Silica particles may also be subjected to various surface treatment, for example, silica particles treated with a silane coupling agent, a titanium coupling agent or silicone oil are preferably used.

The viscoelasticity of the toner may be adjusted by the addition of inorganic particles, or surface gloss of image and penetration into paper may be adjusted by the addition of inorganic particles. The content of inorganic particles is preferably 0.5% by weight or more and 20% by weight or less to 100 parts by weight of the toner starting materials, and more preferably 1% by weight or more and 15% by weight or less.

A charge controlling agent may be added to the toner according to the exemplary embodiment, if necessary. As the charge controlling agent, chromium-based azo dyes, iron-based azo dyes, aluminum-based azo dyes and salicylic acid metal complexes may be used.

<Manufacturing Method of Electrostatic Image Developing Toner>

The toner according to the exemplary embodiment is preferably manufactured by a wet manufacturing method such as an emulsification and aggregation method (an aggregation and coalescence method)

The manufacturing method of the toner in the exemplary embodiment is a method including: an aggregation process of mixing resin particle dispersion having dispersed a resin in a solvent, coloring agent dispersion having dispersed a coloring agent in a solvent, and release agent dispersion having dispersed a release agent in a solvent to form aggregated particles containing the resin particles, release agent and coloring agent; a stopping process of adjusting the pH of the aggregated particles to stop the growth of aggregation of the aggregated particles; fusion process of heating the aggregated particles at temperature higher than the melting temperature or glass transition temperature of the resin particles to fuse the aggregated particles; and a washing process of washing the obtained toner particles by fusion with at least water. A drying process of drying the toner particles may further be added to these processes. If necessary, a shell layer-forming process of adding the same or different resin particles to the aggregated particles to adhere shell layers on the surfaces of the aggregated particles may be provided after the aggregation process.

Each process of in the example of the manufacturing method of the electrostatic image developing toner will be described in detail below. The manufacturing method of the toner in the exemplary embodiment is not restricted thereto.

[Preparation Process of Dispersion]

In the dispersion manufacturing process, resin particle dispersion, coloring agent dispersion, and release agent dispersion are prepared.

The resin particle dispersion may be prepared by known phase inversion emulsifications or by a method of emulsification by heating the reaction system at a temperature higher than the glass transition temperature of the resin and applying mechanical shear force thereto. At this time, an ionic surfactant may be added.

The coloring agent dispersion may be prepared by dispersing coloring agent particles of a desired color such as yellow, cyan, magenta or black in a solvent with an ionic surfactant.

The release agent dispersion may be prepared by dispersing a release agent in water together with a high molecular weight electrolyte (e.g., an ionic surfactant, a high molecular weight acid, or a high molecular weight base) and by heating the reaction system at a temperature higher than the melting temperature of the release agent to make particles with a homogenizer capable of applying strong shear force or with a pressure discharge type disperser.

[Aggregation Process]

In the aggregation process, the resin particle dispersion, coloring agent dispersion and release agent dispersion are mixed to hetero-aggregate the resin and release agent, and if necessary, the coloring agent to form aggregated particles (aggregated core particles) having almost near to a desired toner particle size.

[Shell Layer-Forming Process]

In a shell layer-forming process, aggregated particles (aggregated core/shell particles) having a core/shell structure wherein shell layers are formed on the surfaces of aggregated core particles by adhering resin particles with the resin particle dispersion containing resin particles and forming covering layers (shell layers) having a desired thickness.

The aggregation process and shell layer-forming process may be divided to two or more times and performed repeatedly in stages.

The volume average particle size of the resin particles, coloring agent and release agent for use in the aggregation process and shell layer-forming process is preferably 1 μm or less, and more preferably in the range of 100 nm or more and 300 nm or less, for easy adjustment of the toner particle size and particle size distribution to desired values.

The volume average particle size is measured with a laser diffraction system particle size distribution measuring instrument (LA-700, manufactured by Horiba, Ltd.). As measuring method, the sample in a state of dispersion is adjusted to be about 2 g in a solid state, and ion exchange water is added thereto to make about 40 mL. The resulting sample is poured into a cell to get appropriate concentration, and after about 2 minutes, particle sizes are measured when the concentration in the cell is almost stabilized. The volume average particle size of the obtained every channel is accumulated from the small size side of the volume average particle size and particle sizes giving accumulation of 50% are taken as the volume average particle size.

[Stopping Process]

In a stopping process, aggregation growth of aggregated particles is stopped by adjusting the pH in the aggregation system. For example, growth of aggregated particles is stopped by adjusting the pH in the aggregation system to the range of from 6 to 9.

[Fusion Process]

In a fusion process (a fusion and coalescence process), toner particles are obtained by heating at first the solution containing the aggregated particles obtained by the aggregation process and the shall-forming process performed according to necessity at a temperature higher than the melting temperature or glass transition temperature of the resin particles contained in the aggregated particles, and then fusing and coalescing.

[Washing Process]

In a washing process, the dispersion of toner particles obtained in the fusion process is subjected to solid-liquid separation by at least substitution washing with ion exchange water. The method of solid-liquid separation is not especially restricted but in view of productivity, suction filtration and pressure filtration are preferably used.

[Drying Process]

In a drying process, a solid-liquid separated wet cake is dried to obtain toner particles. Drying method is not especially restricted but freeze drying, flash jet drying, fluidized drying and vibration type fluidized drying are preferably used in view of productivity.

<Physical Properties of Electrostatic Image Developing Toner>

The volume average particle size of the electrostatic image developing toner according to the exemplary embodiment is preferably in the range of 4 μm or more and 8 μm or less, and more preferably in the range of 5 μm or more and 7 μm or less. The number average particle size of the electrostatic image developing toner is preferably in the range of 3 μm or more and 7 μm or less, and more preferably in the range of 4 μm or more and 6 μm or less.

The volume average particle size and number average particle size are measured with COULTER MULTISIZER-II (manufactured by Beckman Coulter Inc.) having an aperture of a diameter of 50 μm. The measurement is performed after the toner is dispersed in an aqueous solution of electrolyte (ISOTON aqueous solution) with an ultrasonic wave for 30 seconds.

The volume average particle size distribution index $GSD_v$ of the electrostatic image developing toner according to the exemplary embodiment is 1.27 or less, and preferably 1.25 or less. When $GSD_v$ exceeds 1.27, particle size distribution is not sharp and resolution property lowers, which sometimes cause splashing of the toner and image quality defect such as fog.

Volume average particle size $D_{50v}$ and volume average particle size distribution index $GSD_v$ are found as follows. The cumulative distributions of the volume and the number are drawn from the small size side in connection with the particle size ranges (channels) divided based on the particle size distribution of the toner measured with COULTER MULTISIZER-II (manufactured by Beckman Coulter Inc.). The particle sizes giving accumulation of 16% are designated as $D_{16v}$ by volume and $D_{16p}$ by number, the particle sizes giving accumulation of 50% are designated as $D_{50v}$ by volume and $D_{50p}$ by number, and the particle sizes giving accumulation of 84% are designated as $D_{84v}$ by volume and $D_{84p}$ by number. $D_{50v}$ represents the volume average particle size, and volume average particle size distribution index ($GSD_v$) is computed as $(D_{84v}/D_{16v})^{1/2}$. $(D_{84p}/D_{16p})^{1/2}$ represents the number average particle size distribution index ($GSD_p$).

Shape factor SF1 of the electrostatic image developing toner according to the exemplary embodiment expressed by the following equation is preferably in the range of 110 or more and 140 or less, and more preferably in the range of 115 or more and 130 or less.

$$SF1 = \frac{(ML)^2}{A} \times \frac{\pi}{4} \times 100$$

In the equation, ML represents the maximum length of the toner particle (μm), and A represents the projected area of the toner particle ($\mu m^2$).

When shape factor SF1 of the toner is smaller than 110 or exceeds 140, there are cases where excellent charging property, cleaning property and transferability cannot be obtained for a long period of time.

Shape factor SF1 is measured as follows with LUZEX image analyzer (manufactured by Nireco Corporation, FT). In the first place, the optical microscope image of the toner particles dispersed on a slide glass is loaded into LUZEX image analyzer through a video camera. The maximum length (ML) and the projected area (A) are measured for 50 toner particles, shape factor SF1 of each toner particle is computed according to the above equation, and then obtained values are averaged as shape factor SF1.

<Electrostatic Image Developer>

The electrostatic image developers in the exemplary embodiment are not especially restricted except for the point that they contain the electrostatic image developing toner of the exemplary embodiment, and proper composition of components may be taken according to purposes. The electrostatic developer in the exemplary embodiment is one-component type electrostatic image developer by using the electrostatic image developing toner alone, and the developer is two-component type electrostatic image developer by using the electrostatic image developing toner in combination with a carrier.

When a carrier is used, the carrier is not especially restricted and known carriers themselves are exemplified. For example, known carriers such as resin-covered carriers as disclosed in JP-A-62-39879 and JP-A-56-11461 can be used.

As the specific examples of carriers, the following resin-covered carriers are exemplified. As the nuclear particles of the carriers, shaped articles of generally used iron powders, ferrite, and magnetite are exemplified, and the volume average particle size thereof is in the range of 30 μm or more and 200 μm or less or so.

The examples of the covering resins for the resin-covered carriers include monomers, homopolymers, and copolymers including two or more monomers of styrenes, e.g., styrene, parachlorostyrene, and α-methylstyrene; α-methylene fatty acid monocarboxylic acids, e.g., methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls, e.g., dimethylaminoethyl methacrylate; vinylnitriles, e.g., acrylonitrile and methacrylonitrile; vinylpyridines, e.g., 2-vinylpyridine and 4-vinylpyridine; vinyl ethers, e.g., vinyl methyl ether and vinyl isobutyl ether; vinyl ketones, e.g., vinyl methyl ketone, vinyl ethyl ketone, and vinyl isopropenyl ketone; olefins, e.g., ethylene and propylene; fluorine-containing vinyl monomers, e.g., vinylidene fluoride, tetrafluoroethylene, and hexafluoroethylene; and further, silicone resins containing methylsilicone or methylphenylsilicone; polyesters containing bisphenol or glycol; epoxy resins; polyurethane resins; polyamide resins; cellulose resins; polyether resins, and polycarbonate. These resins may be used alone or two or more resins may be used in combination. The covering amount of covering resins is preferably in the range of 0.1 parts by weight or more and 10 parts by weight or less or so to 100 parts by weight of the nuclear particles, and more preferably in the range of 0.5 parts by weight or more and 3.0 parts by weight or less.

In the manufacture of the carrier, a heating type kneader, a heating type Henschel mixer, and a UM mixer may be used, and depending upon the amount of the covering resins, a heating type fluidized rolling bed and a heating type kiln may be used.

The mixing ratio of the electrostatic image developing toner in the exemplary embodiment and carrier in the electrostatic image developer is not especially restricted and it can be arbitrarily selected depending upon purpose.

<Toner Cartridge>

The toner cartridge in the exemplary embodiment is not especially restricted so long as it contains the electrostatic image developing toner in the exemplary embodiment. The toner cartridge is, for example, attachable to and detachable from an image-forming apparatus having a developing unit, and contains the electrostatic image developing toner in the exemplary embodiment to be supplied to the developing unit.

<Developer Cartridge>

The developer cartridge in the exemplary embodiment is not especially restricted so long as it contains the electrostatic image developer containing the electrostatic image developing toner in the exemplary embodiment. The developer cartridge is, for example, attachable to and detachable from an image-forming apparatus having a developing unit, and contains the electrostatic image developer containing the electrostatic image developing toner in the exemplary embodiment to be supplied to the developing unit.

<Process Cartridge>

The process cartridge in the exemplary embodiment includes an image holding member and a developing unit of forming a toner image by development of an electrostatic latent image formed on the surface of the image holding member with a developer. The process cartridge in the exemplary embodiment may includes, if necessary, at least one selected from the group consisting of a charging unit for charging the surface of the image holding member, a latent image-forming unit for forming a latent image on the surface of the charged image holding member, a transfer unit for transferring a toner image formed on the surface of the image holding member to a transfer-receiving material, a cleaning unit of the image holding member for removing and cleaning the residual toner on the surface of the image holding member after transfer, and a fixing member for fixing the toner image transferred to a transfer-receiving material.

A schematic block diagram of an example of the process cartridge in the exemplary embodiment is shown in FIG. 1, and the configuration of the process cartridge is described below. Process cartridge 1 includes photoreceptor (electrophotographic photoreceptor) 14 as the image holding member on which an electrostatic latent image is formed, charging apparatus 10 as the charging unit for charging the surface of photoreceptor 14, developing apparatus 16 as the developing unit for forming a toner image by adhering the toner on the electrostatic latent image formed on the surface of photoreceptor 14, and cleaning blade 20 as the cleaning unit of the image holding member for removing and cleaning the residual toner remaining on the surface of photoreceptor 14 after transfer in contact with the surface of photoreceptor 14, which are supported as integration and is attachable to or detachable from an image-forming apparatus. When process cartridge 1 is mounted on an image-forming apparatus, charging apparatus 10, exposure apparatus 12 as the latent image-forming unit for forming an electrostatic latent image on the surface of photoreceptor 14 with laser beam or the reflected light of manuscript, developing apparatus 16, transfer roll 18 as the transfer unit for transfer treating the toner image on the surface of photoreceptor 14 to recording paper 24 which is a transfer-receiving material, and cleaning blade 20 are arranged in this order around photoreceptor 14. Functional units ordinarily necessary in other electrophotographic processes are not shown in FIG. 1.

The operation of process cartridge 1 according to the exemplary embodiment is described below.

In the first place, the surface of photoreceptor 14 is charged with charging apparatus 10 (the charging process). In the next place, light is applied to the surface of photoreceptor 14 by exposure apparatus 12, and charged electricity of the part exposed to light is removed and an electrostatic latent image (an electrostatic image) is formed corresponding to image data (the latent image-forming process). After that, the electrostatic latent image is developed by developing apparatus 16 and a toner image is formed on the surface of photoreceptor 14 (the developing process). For example, in the case of a digital electrophotographic copier using an organic photoreceptor as photoreceptor 14 and laser beam as exposure apparatus 12, the surface of photoreceptor 14 is given negative charge by charging apparatus 10, a dot-form digital latent image is formed by laser beam, and a toner is adhered to the part exposed to laser beam by developing apparatus 16 to visualize the image. In this case, minus bias is applied to developing apparatus 16. Subsequently, by the transfer roll 18, recording paper 24 which is a transfer-receiving material is put over the toner image and charge of reverse polarity to the toner is given to recording paper 24 from the reverse side of recording paper 24, and the toner image is transferred to recording paper 24 by electrostatic force (the transfer process). Heat and pressure are applied to the transferred toner image in a fixing apparatus having fixing roll 22 as the fixing unit, and the toner image is fused and fixed on recording paper 24 (the fixing process). On the other hand, the residues such as the toner and the like not transferred and remained on the surface of photoreceptor 14 are removed with cleaning blade 20 (the cleaning process of the image holding member). One cycle is finished with a series of from the charging process to the image holding member-cleaning process. Incidentally, in FIG. 1, the toner image is directly transferred to recording paper 24 by transfer roll 18, but transfer may be carried out via an intermediate transfer member such as an intermediate transfer belt and the like.

A charger such as Corotron as shown in FIG. 1 is used as charging apparatus 10 as the charging unit, but a conductive or semiconductive charging roll may be used. Contact type chargers using a conductive or semiconductive charging roll may apply a direct current to photoreceptor 14 or may apply an alternate current as superimposed current. By using such charging apparatus 10, the surface of photoreceptor 14 is charged by causing discharge at a minute space in the vicinity of the contact part with photoreceptor 14. The level of charge is generally −300 V or more and −1,000 V or less. Further, the above conductive or semiconductive charging roll may be a monolayer structure or a multilayer structure. Mechanism for cleaning the surface of the charging roll may be provided.

Photoreceptor 14 has at least a function of forming an electrostatic latent image (an electrostatic image). The photoreceptor includes an undercoat layer, a charge generating layer containing a charge generating substance and a charge transport layer containing a charge transport substance formed on the periphery of the cylindrical conductive substrate in this order according to necessity. The order of lamination of the charge generating layer and the charge transport layer may be converse. The photoreceptor is a lamination type photoreceptor laminating two different layers containing a charge generating substance and a charge transport substance (a charge generating layer and a charge transport layer), but the photoreceptor may be a monolayer type photoreceptor containing both a charge generating substance and a charge transport substance in one and the same layer, but is preferably a lamination type photoreceptor. An intermediate layer may be provided between an undercoat layer and a photosensitive layer. A protective layer may be provided on a photosensitive layer. Other kind of photosensitive layer may be used such as an amorphous silicon photosensitive film, not limiting to organic photoreceptor.

Exposure apparatus 12 is not especially restricted and, for example, laser optical systems capable of desirably image-wise exposure with light sources such as semiconductor laser beam, LED (Light Emitting Diode) light or liquid crystal shutter light, and optical equipment such as LED array, on the surface of photoreceptor 14, are exemplified.

The developing unit has a function of forming a toner image by developing the electrostatic latent image formed on photoreceptor 14 with one-component type electrostatic image developer containing an electrostatic image developing toner or two-component type developer. Such a developing apparatus is not especially restricted so long as it has the above function and arbitrarily selected according to purpose. A developing unit having a toner layer in contact with photoreceptor 14 may be used and the type not in contact may also be used. For example, as shown in FIG. 1, known developing machines such as a developing machine having a function of adhering an electrostatic image developing toner on photoreceptor 14 with developing apparatus 16, and a developing machine having a function of adhering a toner on photoreceptor 14 with a brush are exemplified.

As the transfer apparatus, as transfer unit, a transfer apparatus capable of giving to recording paper 24 charge of reverse polarity to the toner from the reverse side of recording paper 24, and transferring the toner image to recording paper 24 by electrostatic force, or a transfer roll using a conductive or semiconductive roll capable of transferring by directly being in contact with the surface of recording paper 24 via recording paper 24, and a transfer roll pressing apparatus, as shown in FIG. 1, may be used. As electric current for transferring to be given to an image holding member, a direct current may be applied to the transfer roll or an alternate current may be applied as superimposed current. A transfer roll may be optionally set depending upon the width of image area to be charged, the shape of the transfer charger, the width of opening and process speed (circumferential speed). In addition, for cost saving, a monolayer type foam roll is preferably used as a transfer roll. As a transfer system, a system of directly transferring to recording paper 24, and a system of transferring to recording paper 24 through an intermediate transfer material may be used.

As the intermediate transfer member, known intermediate transfer members may be used. The materials for use as intermediate transfer members include polycarbonate resin (PC), polyvinylidene fluoride (PVDF), polyalkylene phthalate, blending materials of PC/polyalkylene terephthalate (PAT), and blending materials of ethylene tetrafluoroethylene copolymer (ETFE)/PC, ETFE/PAT, and PC/PAT. In view of mechanical strength, intermediate transfer belts using thermosetting polyimide resins are preferred.

As the image holding member-cleaning unit, a unit adopting any of a blade cleaning system, a brush cleaning system, and a roll cleaning system may be optionally used so long as they are capable of removing the remaining toner on the image holding member and cleaning. Of these systems, a unit using a cleaning blade is preferred. As the materials of the cleaning blade, urethane rubber, neoprene rubber and silicone rubber are exemplified. Of these materials, it is especially preferred to use polyurethane elastic body for excellent abrasion resistance.

The fixing apparatus as fixing unit is not especially restricted so long as it is capable of fixing a toner image transferred to recording paper 24 by heating and pressing, or heating/pressing. For example, a fixing apparatus equipped with a heating roll and a pressing roll is used.

As recording paper 24 which is a transfer-receiving material of a toner image, plain paper for use in an electrophotographic copier and a printer, and an OHP sheet are exemplified. For further improving smoothness of image surface after fixing, the surface of a transfer material is also as smooth as possible and, for example, coat paper obtained by coating the surface of plain paper with a resin or the like, and art paper for printing are preferably used.

<Image-Forming Apparatus>

The image-forming apparatus according to the exemplary embodiment includes an image holding member, a charging unit for charging the surface of the image holding member, a latent image-forming unit for forming a latent image on the surface of the image holding member, a developing unit for forming a toner image by developing the latent image formed on the surface of the image holding member with a developer, and a transfer unit for transferring the developed toner image to a transfer-receiving material. The image-forming apparatus according to the exemplary embodiment may includes, if necessary, at least one selected from the group consisting of a fixing unit for fixing the toner image transferred to a transfer-receiving material, and a cleaning unit of the image holding member for removing and cleaning the residual toner on the surface of the image holding member after transfer. Further, the image-forming apparatus according to the exemplary embodiment is an apparatus using the process cartridge.

Figure 2:
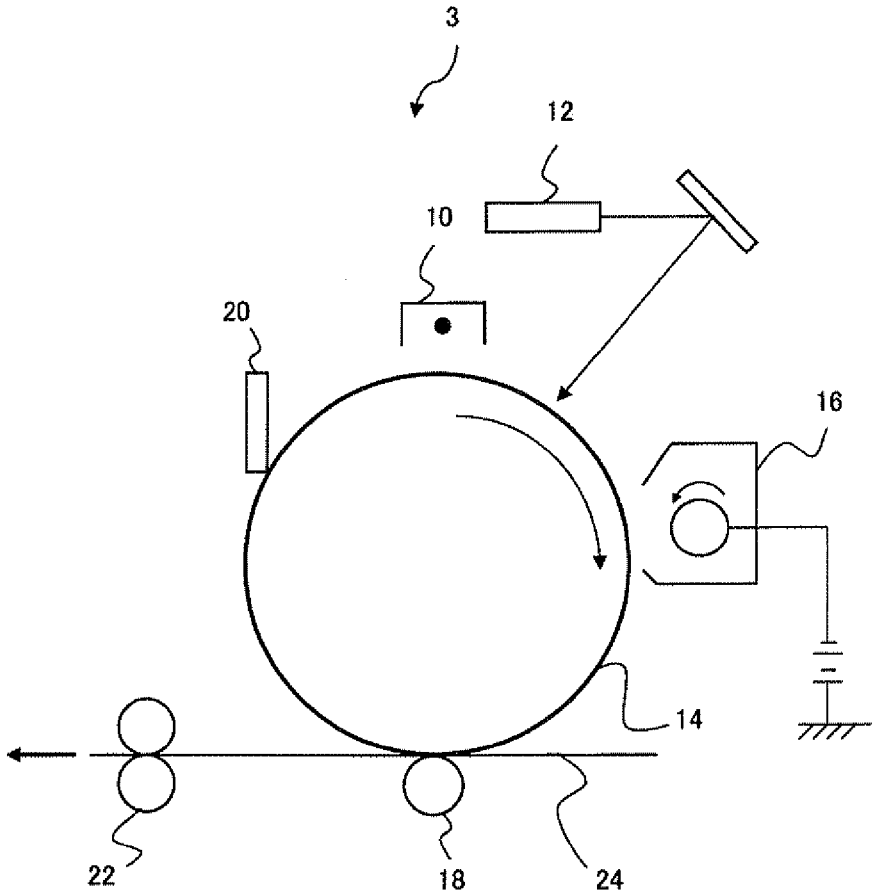
FIG. 2 is a schematic block diagram showing an example of the image-forming apparatus in the exemplary embodiment in the invention.

A schematic block diagram of an example of the image-forming apparatus in the exemplary embodiment is shown in FIG. 2, and the configuration of the image forming apparatus is described below. Image-forming apparatus 3 includes photoreceptor 14 as the image holding member on which an electrostatic latent image is formed, charging apparatus 10 as the charging unit for charging the surface of photoreceptor 14, exposure apparatus 12 as the latent image-forming unit for forming an electrostatic latent image on the surface of photoreceptor 14 with laser beam or the reflected light of manuscript, developing apparatus 16 as the developing unit for forming a toner image by adhering the toner on the electrostatic latent image formed on photoreceptor 14, transfer roll 18 as the transfer unit for transfer-treating the toner image on the surface of photoreceptor 14 to recording paper 24 which is a transfer-receiving material, and cleaning blade 20 as the cleaning unit of the image holding member for removing and cleaning the residual toner remaining on the surface of photoreceptor 14 after transfer in contact with the surface of photoreceptor 14. In image-forming apparatus 3, charging apparatus 10, exposure apparatus 12, developing apparatus 16, transfer roll 18, and cleaning blade 20 are arranged in this order around photoreceptor 14. A fixing apparatus having fixing roll 22 is provided as the fixing unit. Functional units ordinarily necessary in other electrophotographic processes are not shown in FIG. 2. Each configuration and operation at image-forming time in image-forming apparatus 3 are the same with those in process cartridge 1.

Each configuration of the process cartridge and image-forming apparatus in the exemplary embodiment is not restricted to the above and the configurations known as configurations of the process cartridge and image-forming apparatus of ordinary electrophotographic system may be applied. That is, as to a charging unit, a latent image-forming unit, a developing unit, a transfer unit, an image holding member-cleaning unit, a destaticizing unit, a paper feeding unit, a conveying unit, and an image controlling unit, those conventionally known are optionally adopted. The configurations thereof are not especially restricted in the exemplary embodiment.

EXAMPLE

The invention will be described more specifically with reference to examples and comparative examples, but the invention is not restricted to these examples.

Each measurement in the example is performed as follows.

[Measuring Method of Glass Transition Temperature]

The glass transition temperature of the toner and uncolored particles is determined according to a DSC (differential scanning calorimeter) measuring method and found from the subject maximum peak measured in conformity with ASTM D3418-8.

In the measurement of the subject maximum peak, DSC-7 (manufactured by PerkinElmer, Inc.) is used. The melting temperatures of indium and zinc are used for temperature correction of the detecting part of the apparatus, and heat of fusion of indium is utilized for calorimetric correction. An aluminum pan is used as the sample, and an empty pan is set for reference and measurement is performed at a temperature rising rate of 10° C./min.

[Measuring Methods of Molecular Weight and Molecular Weight Distribution]

The molecular weight distribution is measured on the following condition: GPC: "HLC-8120GPC, SC-8020 apparatus (manufactured by Tosoh Corporation)", the columns: two columns of "TSK gel and Super HM-H (6.0 mm ID×15 cm, manufactured by Tosoh Corporation)", and the eluent: THF (tetrahydrofuran). The experiment is performed on the following condition: the sample concentration: 0.5%, the flow rate: 0.6 mL/min, the sample injection: 10 μL, the measuring temperature: 40° C., and the detector: an IR detector. The calibration curve is prepared with ten polystyrene standard samples of TSK Standards: "A-500", "F-1", "F-10", "F-80", "F-380", "A-2500", "F-4", "F-40", "F-128", and "F-700" (manufactured by Tosoh Corporation).

[Measuring Methods of the Number of Uncolored Particles not Containing a Coloring Agent]

Uncolored particles not containing a coloring agent in the toner is observed with an optical microscope of 10×400 magnifications, and the number of uncolored particles in 5,000 toner particles is counted.

[Measuring Method of Shape Factor SF1]

Shape factor SF1 of the toner and uncolored particles is computed according to the following equation.

$$SF1 = \frac{(ML)^2}{A} \times \frac{\pi}{4} \times 100$$

In the equation, ML represents the maximum length of the toner particle (μm), and A represents the projected area of the toner particle ($\mu m^2$).

Shape factor SF1 is measured as follows with LUZEX image analyzer (manufactured by Nireco Corporation, FT). In the first place, the optical microscope image of the toner particles dispersed on a slide glass is loaded into LUZEX image analyzer through a video camera. The maximum length (ML) and the projected area (A) are measured for 50 toner particles or 50 uncolored particles, shape factor SF1 of each toner particle is computed according to the above equation, and then obtained values are averaged as shape factor SF1.

[Measuring Method of Tin Element Content]

The amounts of tin elements contained in the toner and uncolored particles are measured by the ratio of tin and carbon detected from the surfaces of the toner particles and uncolored particles with a scanning electron microscope (SEM-EDX, manufactured by Hitachi Kyowa Engineering Co., Ltd.). Specifically, the ratio of the amounts of carbon and tin is measured, and by comparing the obtained result with the toner and the uncolored particles, the ratio of the amount of the tin element in the uncolored particles to that in the toner is determined.

[Measuring Method of the Coloring Agent Content in Uncolored Particles]

When special metal such as Cu and Ca are contained in the coloring agent, the amount of the coloring agent contained in uncolored particles is obtained by comparing the cross sectional areas of the toner and the uncolored particles by observation of the cross sectional areas with SEM-EDX, or found by dissolving the uncolored particles in a solvent such as acetone or ethyl acetate and by Lambert-Beer's law from the weight of the particles and the amount of the solvent, the absorption wavelength of the coloring agent absorbed and from the extinction coefficient. When the extinction coefficient of the coloring agent to be measured is unknown, the toner is thermally decomposed in DTA, the amount of the component that is decomposed at the highest temperature is measured, the concentration of the coloring agent in the toner is obtained, further the toner is dissolved in the above solvent, and the extinction coefficient is found from the weight of the toner, the amount of the solvent, and the absorption wavelength of the coloring agent absorbed, from which the amount of the coloring agent is measured.

[Analyzing Method of the Components in Uncolored Particles]

The fact that the polyester resin is contained in the uncolored particles is measured with an infrared spectrophotometer (FT-IR, manufactured by Shimadzu Corporation), and absorption wavelength of ester is confirmed.

(Manufacture of Polyester Resin 1)

| | |
|---|---|
| Dimethyl terephthalate (manufactured by Wako Pure Chemical Industries Ltd.) | 10 mols by part |
| Dimethyl fumarate (manufactured by Wako Pure Chemical Industries Ltd.) | 767 mols by part |
| n-Dodecenylsuccinic acid (manufactured by Wako Pure Chemical Industries Ltd.) | 3 mols by part |
| Ethylene oxide adduct of bisphenol A (manufactured by Wako Pure Chemical Industries Ltd.) | 85 mols by part |
| Propylene oxide adduct of bisphenol A (manufactured by Wako Pure Chemical Industries Ltd.) | 15 mols by part |
| Acetone (manufactured by Wako Pure Chemical Industries Ltd.) | 1 mol by part |
| Dibutyltin oxide (manufactured by Wako Pure Chemical Industries Ltd.) | 0.05 mols by part |

The above components are put in a flask replaced with nitrogen and stirred at 10° C. for 6 hours. After that, the temperature is raised and the reaction is continued at 150° C. for 4.5 hours and at 200° C. for 6 hours under reduced pressure, and 8 parts by weight of trimellitic anhydride and 0.02 parts by weight of dibutyltin oxide are added to the reaction solution, and further reaction is continued under reduced pressure for 30 minutes to obtain polyester resin 1 having a number average molecular weight of 13,000, a weight average molecular weight (Mw) of 21,000, and glass transition temperature (Tg) of 63° C.

(Manufacture of Resin Particle Dispersion 1)

The above polyester resin is conveyed to Cavitron CD1010 (manufactured by Eurotec, Co., Ltd.) at a speed of 100 g/min while maintaining a fused state. Dilute aqueous ammonia having concentration of 0.37% by weight obtained by diluting reagent aqueous ammonia with ion exchange water is put in a separately prepared aqueous medium tank and conveyed to the above Cavitron at a speed of 0.1 liter/min with the above polyester resin melt, while heating at 120° C. with a heat exchanger. Cavitron is driven in the condition of rotation speed of rotor of 60 Hz and pressure of 5 kg/cm$^2$ to obtain resin particle dispersion having a volume average particle size of 160 nm and solid content of 30% by weight. Further, by the centrifugal separation treatment on the following condition, resin particle dispersion 1 is obtained.

[Condition of Centrifugal Separation]

Apparatus: centrifugal separator Himac CR 22G (manufactured by Hitachi, Ltd.)

Rotation number: 12,000 rpm

Time of separation: 30 min

Solvent: methyl ethyl ketone (MEK)

Sample concentration: a 10% by weight solution (Manufacture of Coloring Agent Dispersion 1)

| | |
|---|---|
| Cyan pigment (Pigment Blue 15:3, manufactured by Dainichiseika Color & Chemicals Mfg. Co., Ltd.) | 20 parts by weight |
| Anionic surfactant (Neogen SC, manufactured by Dai-Ichi Kogyo Seiyaku Co., Ltd.) | 2 parts by weight |
| Ion exchange water | 80 parts by weight |

The above components are mixed and dispersed with a high pressure impact type disperser Altimizer (HJP30006, manufactured by Sugino Machine Limited) for 1 hour to obtain coloring agent dispersion 1 having a volume average particle size of 180 nm and solid content of 20% by weight.

(Manufacture of Release Agent Dispersion 1)

| | |
|---|---|
| Paraffin wax (HNP-9, manufactured by Nippon Seiro Co., Ltd.) | 19 parts by weight |
| Anionic surfactant (Neogen SC, manufactured by Dai-Ichi Kogyo Seiyaku Co., Ltd.) | 1 part by weight |
| Ion exchange water | 80 parts by weight |

The above components are mixed in a heat resisting container, the temperature is raised to 90° C. and stirred for 30 minutes. Subsequently, the fused solution is flowed to Gaulin Homogenizer from the bottom of the container and subjected to circulation running corresponding to three passes on the pressure condition of 5 MPa, and then pressure is increased to 35 MPa and further circulation running corresponding to three passes is performed. The thus-obtained emulsified liquid is cooled to 40° C. in the heat resisting container, and release agent dispersion 1 is obtained. The volume average particle size of release agent dispersion 1 measured with particle size distribution measuring instrument LA-700 (manufactured by Horiba, Ltd.) is 240 nm.

(Manufacture of Toner Particles 1 and Toner 1)

| | |
|---|---|
| Resin particle dispersion 1 | 150 parts by weight |
| Coloring agent dispersion 1 | 30 parts by weight |
| Release agent dispersion 1 | 40 parts by weight |
| Polyaluminum chloride | 0.4 parts by weight |

The above components are mixed and dispersed with ULTRA-TURRAX (manufactured by IKA Japan, K.K.), and then heated up to 48° C. while stirring the flask in an oil bath for heating. The reaction system is retained at 48° C. for 80 minutes, and then 70 parts by weight of resin particle dispersion 1 is gently added thereto. After that, the pH in the reaction system is adjusted to 6.0 with a sodium hydroxide aqueous solution of concentration of 0.5 mol/L. The stainless steel flask is then sealed. The flask is heated up to 97° C. while sealing the shaft of stirrer by magnetic seal and stirring is continued, and the condition is retained for 3 hours. After finish of retaining, the system is cooled at a temperature lowering speed of 1° C./min, filtered, washed with ion exchange water, solid-liquid separated by Nutsche suction filtration, re-dispersed in 3 liters of ion exchange water at 40° C., stirred at 300 rpm for 15 minutes, and washed. The washing operation is repeated 5 times, and solid-liquid separation is performed by Nutsche suction filtration with No. 5A filter at the time when the pH of filtrate is 6.5 and electric conductivity is 7.5 μS/cm, and the reaction system is then dried by vacuum drying at 40° C. for 12 hours to obtain toner particles 1.

Volume average particle size $D50_v$ of toner particles 1 measured with COULTER MULTISIZER-II (manufactured by Beckman Coulter Inc.) is 6.0 μm and volume average particle size distribution index $GSD_v$ is 1.21.

Toner 1 is manufactured by adding, to this toner particles, silica ($SiO_2$) particles having a primary average particle size of 40 nm having been subjected to surface phobitization treatment with hexamethyldisilazane (hereinafter referred to "HMDS" in some cases), and metatitanic acid compound particles having a primary average particle size of 20 nm, which is a reaction compound of metatitanic acid and isobutyl trimethoxysilane, in a covering rate of the toner particle surfaces of 40%, and then mixing the particles with a Henschel mixer at a circumferential speed of 25 m/sec for 5 minutes.

The number of uncolored particles in toner 1 having SF1 of 110 or less (A), the ratio of Sn element contained in the uncolored particles having SF1 of 110 or less to the amount of Sn element contained in the toner particles (B), and the amount of the coloring agent in the uncolored particles having SF1 of 110 or less (C) are shown in Table 1 below.

(Manufacture of Toner Particles 2 and Toner 2)

Resin particle dispersion 2 is manufactured in the same manner as in the manufacture of resin particle dispersion 1 except for changing the centrifugal separation condition to 12,000 rpm for 15 minutes, and toner particles 2 and toner 2 are manufactured in the same manner as in the manufacture of toner particles 1 and toner 1. The results of A, B and C are shown in Table 1 below.

(Manufacture of Toner Particles 3 and Toner 3)

Resin particle dispersion 3 is manufactured in the same manner as in the manufacture of resin particle dispersion 1 except for changing the centrifugal separation condition to 12,000 rpm for 10 minutes, and toner particles 3 and toner 3 are manufactured in the same manner as in the manufacture of toner particles 1 and toner 1. The results of A, B and C are shown in Table 1 below.

(Manufacture of Toner Particles 4 and Toner 4)

Resin particle dispersion 4 is manufactured in the same manner as in the manufacture of resin particle dispersion 1 except for changing the centrifugal separation condition to 10,000 rpm for 10 minutes, and toner particles 4 and toner 4 are manufactured in the same manner as in the manufacture of toner particles 1 and toner 1. The results of A, B and C are shown in Table 1 below.

(Manufacture of Toner Particles 5 and Toner 5)

Resin particle dispersion 5 is manufactured in the same manner as in the manufacture of resin particle dispersion 1 except for changing the centrifugal separation condition to 8,000 rpm for 8 minutes, and toner particles 5 and toner 5 are manufactured in the same manner as in the manufacture of toner particles 1 and toner 1. The results of A, B and C are shown in Table 1 below.

(Manufacture of Toner Particles 6 and Toner 6)

Resin particle dispersion 6 is manufactured in the same manner as in the manufacture of resin particle dispersion 1 except for changing the centrifugal separation condition to 8,000 rpm for 6 minutes and sample concentration to 7% by weight, and toner particles 6 and toner 6 are manufactured in the same manner as in the manufacture of toner particles 1 and toner 1. The results of A, B and C are shown in Table 1 below.

(Manufacture of Toner Particles 7 and Toner 7)

Resin particle dispersion 7 is manufactured in the same manner as in the manufacture of resin particle dispersion 1 except for changing the centrifugal separation condition to 5,000 rpm for 10 minutes and sample concentration to 5% by weight, and toner particles 7 and toner 7 are manufactured in the same manner as in the manufacture of toner particles 1 and toner 1. The results of A, B and C are shown in Table 1 below.

(Manufacture of Toner Particles 8 and Toner 8)

Resin particle dispersion 8 is manufactured in the same manner as in the manufacture of resin particle dispersion 1 except for changing the stirring before polymerization to 10° C. for 3 hours, and toner particles 8 and toner 8 are manufactured in the same manner as in the manufacture of toner particles 1 and toner 1. The results of A, B and C are shown in Table 1 below.

(Manufacture of Toner Particles 9 and Toner 9)

Resin particle dispersion 9 is manufactured in the same manner as in the manufacture of resin particle dispersion 1 except for changing the stirring before polymerization to 10° C. for 1 hour, and toner particles 9 and toner 9 are manufactured in the same manner as in the manufacture of toner particles 1 and toner 1. The results of A, B and C are shown in Table 1 below.

(Manufacture of Toner Particles 10 and Toner 10)

Resin particle dispersion 10 is manufactured in the same manner as in the manufacture of resin particle dispersion 1 except for changing the addition amount of acetone to 0.2 parts by mol, and toner particles 10 and toner 10 are manufactured in the same manner as in the manufacture of toner particles 1 and toner 1. The results of A, B and C are shown in Table 1 below.

(Manufacture of Toner Particles 11 and Toner 11)

Resin particle dispersion 11 is manufactured in the same manner as in the manufacture of resin particle dispersion 1 except for changing the stirring before polymerization to 10° C. for 1 hour and the addition amount of acetone to 0.1 part by mol, and toner particles 11 and toner 11 are manufactured in the same manner as in the manufacture of toner particles 1 and toner 1. The results of A, B and C are shown in Table 1 below.

(Manufacture of Toner Particles 12 and Toner 12)

Resin particle dispersion 12 is manufactured in the same manner as in the manufacture of resin particle dispersion 2 except for changing the stirring before polymerization to 10° C. for 3 hours, and toner particles 12 and toner 12 are manufactured in the same manner as in the manufacture of toner particles 2 and toner 2. The results of A, B and C are shown in Table 1 below.

(Manufacture of Toner Particles 13 and Toner 13

Resin particle dispersion 13 is manufactured in the same manner as in the manufacture of resin particle dispersion 2 except for changing the stirring before polymerization to 10°

C. for 1 hour, and toner particles 13 and toner 13 are manufactured in the same manner as in the manufacture of toner particles 2 and toner 2. The results of A, B and C are shown in Table 1 below.

(Manufacture of Toner Particles 14 and Toner 14)

Resin particle dispersion 14 is manufactured in the same manner as in the manufacture of resin particle dispersion 3 except for changing the stirring before polymerization to 10° C. for 3 hours, and toner particles 14 and toner 14 are manufactured in the same manner as in the manufacture of toner particles 3 and toner 3. The results of A, B and C are shown in Table 1 below.

(Manufacture of Toner Particles 15 and Toner 15)

Resin particle dispersion 15 is manufactured in the same manner as in the manufacture of resin particle dispersion 4 except for changing the addition amount of acetone to 0.2 parts by mol, and toner particles 15 and toner 15 are manufactured in the same manner as in the manufacture of toner particles 4 and toner 4. The results of A, B and C are shown in Table 1 below.

(Manufacture of Toner Particles 16 and Toner 16)

Resin particle dispersion 16 is manufactured in the same manner as in the manufacture of resin particle dispersion 4 except for changing the stirring before polymerization to 10° C. for 1 hour and the addition amount of acetone to 0.1 part by mol, and toner particles 16 and toner 16 are manufactured in the same manner as in the manufacture of toner particles 4 and toner 4. The results of A, B and C are shown in Table 1 below.

(Manufacture of Toner Particles 17 and Toner 17)

Resin particle dispersion 17 is manufactured in the same manner as in the manufacture of resin particle dispersion 5 except for changing the addition amount of acetone to 0.2 parts by mol, and toner particles 17 and toner 17 are manufactured in the same manner as in the manufacture of toner particles 5 and toner 5. The results of A, B and C are shown in Table 1 below.

(Manufacture of Toner Particles 18 and Toner 18)

Resin particle dispersion 18 is manufactured in the same manner as in the manufacture of resin particle dispersion 5 except for changing the stirring before polymerization to 10° C. for 1 hour and the addition amount of acetone to 0.1 part by mol, and toner particles 18 and toner 18 are manufactured in the same manner as in the manufacture of toner particles 5 and toner 5. The results of A, B and C are shown in Table 1 below.

(Manufacture of Toner Particles 19 and Toner 19)

Resin particle dispersion 19 is manufactured in the same manner as in the manufacture of resin particle dispersion 6 except for changing the addition amount of acetone to 0.2 parts by mol, and toner particles 19 and toner 19 are manufactured in the same manner as in the manufacture of toner particles 6 and toner 6. The results of A, B and C are shown in Table 1 below.

(Manufacture of Toner Particles 20 and Toner 20)

Resin particle dispersion 20 is manufactured in the same manner as in the manufacture of resin particle dispersion 6 except for changing the stirring before polymerization to 10° C. for 1 hour and the addition amount of acetone to 0.1 part by mol, and toner particles 20 and toner 20 are manufactured in the same manner as in the manufacture of toner particles 6 and toner 6. The results of A, B and C are shown in Table 1 below.

(Manufacture of Toner Particles 21 and Toner 21)

Resin particle dispersion 21 is manufactured in the same manner as in the manufacture of resin particle dispersion 1 except for not adding dodecenylsuccinic acid, and toner particles 21 and toner 21 are manufactured in the same manner as in the manufacture of toner particles 1 and toner 1. The results of A, B and C are shown in Table 1 below.

(Manufacture of a Developer)

Two-component type developer is prepared by mixing 8 parts by weight of each of obtained toners 1 to 21, and 100 parts by weight of a carrier (volume average particle size: 45 μm) obtained by resin-covering ferrite particles with 1.5% PMMA (Mw: 75,000, manufactured by Soken Chemical & Chemical Engineering Co., Ltd.).

(Evaluation of Image Quality)

Image formation of image density 1% (A4 size paper containing a solid image of 6.2 mm×1 mm) is repeated with 2,000 sheets of paper (C2r paper, manufactured by Fuji Xerox Co., Ltd.) and a color copier (Docu Centre Color a 450, manufactured by Fuji Xerox Co., Ltd.). After that, the condition of deformation of the cleaning blade (polyurethane) and the state of generation of image defect of color streak are visually evaluated according to the following criteria. The results obtained are shown in Table 1.

[Deformation of the Cleaning Blade and the State of Generation of Image Defect of Color Streak]

A: Deformation of the cleaning blade is not observed and a color streak is also not confirmed.

B: Deformation of the cleaning blade is observed but a color streak is not confirmed on the image.

C: Deformation of the cleaning blade is observed, and a color streak is observed on the photoreceptor but not observed on the image.

D: A color streak is slightly confirmed on the image

E: A color streak is confirmed on the image on an intolerable level.

Incidentally, a tolerable level is from A to D.

Examples 1 to 20 and Comparative Example 1

The developers using each of toners 1 to 21 are evaluated by the above criteria as in Table 1. The results are shown in Table 1.

TABLE 1

| Example No. | Toner | A | B | C | Dodecenyl Succinic Acid | Evaluation |
|---|---|---|---|---|---|---|
| Example 1 | 1 | 5 | 1.1 | 5 | Present | A |
| Example 2 | 2 | 13 | 1.1 | 5 | Present | A |
| Example 3 | 3 | 17 | 1.2 | 11 | Present | B |
| Example 4 | 4 | 27 | 1.2 | 11 | Present | B |
| Example 5 | 5 | 32 | 1.3 | 17 | Present | C |
| Example 6 | 6 | 48 | 1.4 | 17 | Present | C |
| Example 7 | 8 | 6 | 1.8 | 6 | Present | A |
| Example 8 | 9 | 7 | 2.1 | 13 | Present | B |
| Example 9 | 10 | 9 | 2.8 | 12 | Present | B |
| Example 10 | 11 | 11 | 3.2 | 16 | Present | C |
| Example 11 | 12 | 13 | 1.8 | 5 | Present | A |
| Example 12 | 13 | 12 | 2.2 | 11 | Present | B |
| Example 13 | 14 | 18 | 1.8 | 11 | Present | B |
| Example 14 | 15 | 26 | 2.8 | 13 | Present | B |
| Example 15 | 16 | 27 | 3.3 | 18 | Present | C |
| Example 16 | 17 | 33 | 2.7 | 17 | Present | C |
| Example 17 | 18 | 33 | 3.2 | 22 | Present | D |
| Example 18 | 19 | 47 | 2.7 | 17 | Present | C |
| Example 19 | 20 | 48 | 3.3 | 25 | Present | D |
| Example 20 | 21 | 7 | 1.2 | 9 | Absent | B |
| Comparative Example 1 | 7 | 53 | 1.3 | 30 | Present | E |

A: The number of uncolored particles having SF1 of 110 or less.

B: The ratio of Sn element contained in the uncolored particles having SF1 of 110 or less to the amount of Sn element contained in the toner particles C: The amount of the coloring agent in the uncolored particles having SF1 of 110 or less.

As can be seen from Table 1, the toners in Examples 1 to 20 restrain deformation of the cleaning blade even when the cleaning blade is used as the cleaning unit of the image holding member, and generation of image defect of color streak is inhibited, as compared with the toner in Comparative Example 1.

While the present invention has been shown and described with reference to certain exemplary embodiments thereof, it will be understood by those skilled in the art that various changes modifications may be made therein without departing from the spirit and scope of the present invention as defined by the appended claims.

What is claimed is:

1. A toner for electrostatic image development comprising:

a toner particle containing a polyester resin and a coloring agent; and an uncolored particle containing a polyester resin and not containing a coloring agent, wherein a ratio of an amount of a Sn element contained in the uncolored particle to an amount of a Sn element contained in the toner particle is from 1.1 to 3.0, a shape factor SF1 of the uncolored particles is 110 or less, and a number of the uncolored particles is 50 or less based on 5,000 toner particles.

2. The toner for electrostatic image development as claimed in claim 1, wherein the Sn element contained in the uncolored particle is a tin compound catalyst used in polymerization of the polyester resin.

3. The toner for electrostatic image development as claimed in claim 1, wherein an alkenylsuccinic acid is contained as a constitutional component of the polyester resin contained in both the toner particle and the uncolored particle.

4. The toner for electrostatic image development as claimed in claim 1, wherein a weight average molecular weight Mw of the polyester resins contained in both the toner particle and the uncolored particle is 5,000 or more.

5. The toner for electrostatic image development as claimed in claim 1, wherein the toner particle comprises a release agent, and a content of the release agent is from 1 part by weight to 10 parts by weight with respect to 100 parts by weight of the polyester resin contained in the toner particle.

6. The toner for electrostatic image development as claimed in claim 1, which has a volume average particle size of from 4 μm to 8 μm.

7. The toner for electrostatic image development as claimed in claim 1, which has a volume average particle size distribution index $GSD_v$ of 1.27 or less.

8. The toner for electrostatic image development as claimed in claim 1, which has a shape factor SF1 of 110 or more and 140 or less.

9. A developer for electrostatic image development comprising the toner as claimed in claim 1.

10. An image-forming method comprising:

a charging process for charging a surface of an image holding member;

a latent image-forming process for forming an electrostatic latent image on the surface of the image holding member;

a developing process for forming a toner image by developing the electrostatic latent image formed on the surface of the image holding member with a developer; and a transfer process for transferring the developed toner image to a transfer-receiving material;

wherein the developer is the developer for electrostatic image development as claimed in claim 9.

* * * * *